US006106091A

United States Patent [19]

Osawa et al.

[11] Patent Number: 6,106,091

[45] **Date of Patent: *Aug. 22, 2000**

[54] METHOD OF DRIVING INK-JET HEAD BY SELECTIVE VOLTAGE APPLICATION

[75] Inventors: Seiichi Osawa, Oyama; Akio Segawa, Sayama; Tadashi Mitsuhasi, Tokorozawa, all of Japan

[73] Assignee: Citizen Watch Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/750,470

[22] PCT Filed: May 30, 1995

[86] PCT No.: PCT/JP95/01044

§ 371 Date: Dec. 13, 1996

§ 102(e) Date: Dec. 13, 1996

[87] PCT Pub. No.: WO95/34427

PCT Pub. Date: Dec. 21, 1995

[30] Foreign Application Priority Data

Jun. 15, 1994 [JP] Japan ..... 6-132333

[51] Int. Cl.[7] ..... B41J 29/38

[52] U.S. Cl. ..... 347/9

[58] Field of Search ..... 347/9, 10, 11, 347/68–72

[56] References Cited

U.S. PATENT DOCUMENTS 5,757,392 5/1998 Zhang ..... 347/9

FOREIGN PATENT DOCUMENTS

| | | |
|---|---|---|
| 53-12138 | 4/1978 | Japan . |
| 57-176055 | 10/1984 | Japan . |
| 63-53082 | 3/1988 | Japan . |
| 63-252750 | 10/1988 | Japan . |
| 3-222750 | 10/1991 | Japan . |
| 3-224745 | 10/1991 | Japan . |
| 6-8427 | 1/1994 | Japan . |
| 6-340075 | 12/1994 | Japan . |

*Primary Examiner*—John Barlow
*Assistant Examiner*—C. Dickens
*Attorney, Agent, or Firm*—Armstrong, Westerman, Hattori, McLeland & Naughton

[57] ABSTRACT

A piezoelectric actuator is deformed from an initial condition for a time (T1) in a direction, in which an inner volume of an ink chamber is increased, to supply ink to the ink chamber. Subsequently, the piezoelectric actuator is deformed for a time (T2) at a considerably slow speed as compared with the time (T1) for the preceding supply of ink to gradually increase the inner volume of the ink chamber to supply ink to the ink chamber. During the time (T2), free oscillation having generated in ink in the piezoelectric actuator and the ink chamber attenuates. Subsequently, the piezoelectric actuator is rapidly deformed to compress the ink chamber, thereby jetting ink in the ink chamber via nozzle holes.

21 Claims, 13 Drawing Sheets

| DRIVING FREQUENCY (KHz) | TEST2 (m/S) | COMPARATIVE EXAMPLE (m/S) |
|---|---|---|
| 0.25 | 5.0 | 5.0 |
| 2 | 5.0 | 5.0 |
| 4 | 5.4 | 7.0 |
| 6 | 4.9 | 6.0 |
| 8 | 4.8 | — |
| 10 | 5.1 | — |

| T2 (uS) | 4.80 | 13.0 | 22.4 | 31.6 | 42.2 | 52.2 | 62.8 | 67.8 | 80 |
|---|---|---|---|---|---|---|---|---|---|
| V2 (v) | 13.0 | 14.0 | 15.1 | 16.1 | 17.2 | 18.2 | 19.0 | 19.6 | 20.8 |
| DIAMETER OF INK DROPLET (mm) | 22 | 25 | 28 | 35 | 38 | 41 | 43 | 45 | 48 |
| SPEED OF INK DROPLET (m/S) | 4.5 | 5.0 | 5.2 | 5.0 | 5.2 | 5.1 | 5.1 | 5.0 | 5.1 |
| INK PIXEL (μm) | 42 | 48 | 53 | 60 | 65 | 70 | 78 | 82 | 93 |

METHOD OF DRIVING INK-JET HEAD BY SELECTIVE VOLTAGE APPLICATION

TECHNICAL FIELD

The present invention relates to a method of driving an ink-jet head which selectively deposits ink droplets on an image recording medium, for example, paper.

BACKGROUND TECHNOLOGY

Of non-impact printers which are largely increasing their shares in the market nowadays, ink-jet printers are the simplest in principle, and also suitable for color printing. Of the ink-jet printers, so-called drop-on-demand (DOD) type ink-jet printers, which eject ink droplets only at the time of forming dots, are the most popular.

As a so-called piezoelectric ink-jet head using piezoelectric actuators among ink-jet heads for the DOD type ink-jet printers, there are a Kaiser type one as disclosed in Japanese Patent Publication No. 53-12138, a laminated piezoelectric actuator type one as disclosed in Japanese Patent Laid-Open Publication No. 6-8427, and a share-mode type one as disclosed in Japanese Patent Laid-Open Publication No. 63-252750.

In the piezoelectric ink-jet heads, motions of supplying ink to ink chambers from an ink supply source leading to the ink chambers, and a motion of ejecting ink droplets through nozzle holes formed in the ink chambers are executed by deforming the piezoelectric actuators with a voltage applied thereon, thus changing an inner volume of each of the ink chambers.

Conventional piezoelectric ink-jet heads are driven in a manner described hereafter. The wall faces of ink chambers are partially deformed by applying a voltage varying in a pulse waveform to the piezoelectric actuators, thereby increasing an inner volume of each of the ink chambers. In this step of driving operation, ink is supplied to the ink chambers.

Subsequently, the wall faces of the ink chambers are deformed in a reverse direction by stopping to apply the voltage to the piezoelectric actuators or by applying a voltage varying in a waveform of reverse polarity against the aforesaid waveform to the piezoelectric actuators, thus reducing the inner volume of each of the ink chambers. In this step of driving operation, ink is ejected through nozzle holes. Such a driving method is generally called the "pull-in shot" method.

FIG. 15 shows a pulse waveform of a voltage applied to the piezoelectric actuators and a displacement waveform of the piezoelectric actuators in a conventional method of driving an ink-jet head. In the figure, a waveform (a) indicates the pulse waveform of a voltage applied to the piezoelectric actuators, and a waveform (b) the displacement waveform of the piezoelectric actuators.

As shown in FIG. 15, the piezoelectric actuators which are in an initial condition over an interval of time T0 are charged with electric charge and deformed over an interval of time T1 when a voltage in a pulse waveform is applied thereto. Deformation of the piezoelectric actuators is accompanied by deformation of the walls of the ink chambers, increasing the inner volumes of the ink chambers and supplying ink into the ink chambers. Hereupon, free oscillation of the piezoelectric actuators as well as the ink in the ink chambers continues at a natural oscillation frequency even after deformation stops.

Electric charge that has built up in the piezoelectric actuators is discharged over an interval of time T2, and reverts to its initial condition. Hereupon, the inner volumes of the ink chambers are rapidly reduced, pressurizing the ink chambers and ejecting ink droplets out of the nozzle holes leading to the ink chambers. The free oscillation of the piezoelectric actuators continues at the natural oscillation frequency thereof centered around the initial position even after the ink droplets are ejected.

In the aforesaid conventional method of driving the ink-jet head, rapid supply of ink into the ink chambers is ensured, but on the other hand, the ink droplets are formed before the free oscillation that occurs in the piezoelectric actuators as well as the ink in the ink chambers damps out in case that the piezoelectric actuators are driven at a high frequency in order to increase printing speed. As a result, problems of the ink droplets breaking up or vaporizing have been encountered.

There is a method of driving an ink-jet head overcoming such problems described above by gradually increasing a voltage applied to the piezoelectric actuators while electric current is kept at a constant level. FIG. 16 is a diagram showing such a conventional method of driving an ink-jet head as described in the foregoing. In the figure, a waveform (a) indicates a waveform of a voltage applied to the piezoelectric actuators, and a waveform (b) a displacement waveform of the piezoelectric actuators.

Specifically, the piezoelectric actuators which are in an initial condition over an interval of time T0 are gradually charged with electric charge and deformed when a voltage varying in a waveform as indicated by the waveform (a) in FIG. 16 is applied thereto. Such deformation of the piezoelectric actuators is accompanied by gradual deformation of the walls of the ink chambers, and an increase of an inner volume of each of the ink chambers, thereby supplying ink into the ink chambers.

When a voltage in the waveform as indicated by the waveform (a) in FIG. 16 is applied to the piezoelectric actuators over an interval of time T2, electric charge is discharged therefrom, returning the piezoelectric actuators to their initial condition. Hereupon, the inner volume of each of the ink chambers is reduced, and the ink chambers are pressurized, ejecting ink droplets out of the nozzle holes. The free oscillation of the piezoelectric actuators as well as the ink in the ink chambers that occurs in the step of supplying ink is small in amplitude, and damps out in a short time.

However, in the method of driving the ink-jet head by applying a voltage in the waveform as shown in FIG. 16, the piezoelectric actuators are driven slowly in order to keep amplitudes of the free oscillations of the ink in the ink chambers as well as the piezoelectric actuators to a minimum. Consequently, as the time required for completing the step of supplying ink, that is, the interval T1 becomes longer, ink can not be ejected at a high cycle speed, causing a problem of the printing speed becoming slower.

Normally, in driving an ink-jet printer, the size of each ink droplet ejected from the nozzle holes is adequately adjusted according to the contents of printing.

For example, in the driving method described in the foregoing (for example, refer to FIG. 15), the longer the interval T1, the greater the amount of ink ejected becomes. However, with such a method, a period in case of continuous driving is lengthened due to a prolonged time needed for applying a voltage, resulting in a slower printing speed. Accordingly, the size of each ink droplet used to be adjusted in the past by increasing or decreasing the amount of ink ejected by means of varying a voltage applied to the piezoelectric actuators.

However, in case that the diameter of an ink droplet is adjusted only by varying the value of a voltage applied to the piezoelectric actuators, a problem arises wherein ink droplets of large diameter as targeted could not be formed because a sufficient amount of ink was not made available owing to a longer time required in supplying ink into the ink chambers for forming large-sized ink droplets than a time required for forming small-sized ink droplets.

In addition, it was difficult to enable an ink-jet head to acquire such a characteristic as capability of attaining linear variation in the diameter of each ink droplet, ranging from small to large, only by means of varying a voltage applied to the piezoelectric actuators and, furthermore, there was difficulty with controlling the voltage.

Furthermore, as free oscillation is caused to occur to ink inside the ink chambers by an ejection motion of ink, the position of a meniscus, that is, an ejection surface of ink in respective nozzle holes becomes unstable, and in case that the piezoelectric actuators are driven in such a condition to carry out a succeeding step of ejecting ink, fluctuation in both the diameter of each ink droplet and an ejection speed thereof results. Also, there is a risk of the occurrence of such a phenomenon as a succeeding ink droplet ejected being broken up when residual free oscillation still remains in ink. For this reason, a succeeding step of ejecting ink can not be carried out until the residual oscillation subsides, causing a problem of a printing speed being reduced.

In the light of the foregoing, it is an object of the present invention to provide a method of driving an ink-jet head, while solving such problems as described above. More specifically, the results stated hereafter are achieved by use of the method of driving an ink-jet head, according to the invention.

Rapid supply motions of ink into the ink chambers are ensured.

Ink droplets of consistent quality can be ejected at a high cycle by damping the residual free oscillation of the piezoelectric actuators that remains after completion of a step of supplying ink.

Ink droplets ejected out of the nozzle holes are formed in a required size with ease.

Ink droplets can be ejected steadily at a constant speed regardless of the size thereof and high speed cycle ejection motions of ink can be coped with without trouble.

DISCLOSURE OF THE INVENTION

Driving Method: First Embodiment

The method of driving an ink-jet head, wherein the inner volumes of respective ink chambers are changed by deforming piezoelectric actuators by applying a voltage thereto, and an action of supplying ink from an ink supply source linked with the ink chambers is followed by an action of ejecting ink droplets out of nozzle holes linked with the ink chambers, according to first embodiment of the invention is characterized in comprising the following steps.

Specifically, ink is supplied into the ink chambers in a step of supplying ink, and then, in a step of ejecting ink, ink droplets are ejected out of the nozzle holes by deforming the piezoelectric actuators in such a direction as to reduce rapidly the inner volume of each of the ink chambers.

The driving method according to the invention is characterized by the step of supplying ink being divided into at least two steps, that is, a first ink supply step and a second ink supply step. In the first ink supply step, the piezoelectric actuators are deformed to increase the inner volume of each of the ink chambers from an initial condition thereof. In the second ink supply step, the piezoelectric actuators are deformed to increase the inner volume of respective ink chambers linearly, but at a significantly slower speed than for the first ink supply step.

With such a driving method as above, a length of a driving time is shortened since, in the first ink supply step, the piezoelectric actuators are deformed at a high speed while, in the second ink supply step, the piezoelectric actuators are deformed gradually until a full amount of deformation required is achieved. At the same time, free oscillations occurring to the piezoelectric actuators after deformation can be damped.

The driving method according to the invention is effective also with a piezoelectric actuator composed of laminated layers, formed by piezoelectric materials and electrodes alternately laminated, and having a piezoelectric strain coefficient $d_{33}$.

In this case, it is preferable to have the inner volume of each ink chamber reduced in an initial condition of driving condition by applying a voltage to the piezoelectric actuators in the same direction as that in which piezoelectric materials are polarized.

Then, in a first ink supply step, the piezoelectric actuators are deformed to increase an inner volume of each of the ink chambers compared to the initial condition. A second ink supply step and a step of ejecting ink are the same as those described in the foregoing.

Furthermore, it is preferable in achieving a smooth and stable driving of the ink-jet head to include a restoration step after completion of the step of ejecting ink wherein the inner volume of each of the ink chambers is restored to the initial condition by controlling the behavior of the piezoelectric actuators.

Driving Method: Second Embodiment

The method of driving an ink-jet head, wherein the inner volumes of respective ink chambers are changed by deforming the piezoelectric actuators by applying a voltage thereto, and an action of supplying ink from an ink supply source linked with the ink chambers is followed by an action of ejecting ink droplets out of nozzle holes linked with the ink chambers, according to the invention is characterized in comprising the following steps.

The second embodiment, which is in principle similar to the first embodiment, comprises a step of supplying ink wherein ink is supplied into the ink chambers by deforming the piezoelectric actuators in such a direction as to increase the inner volume of each of the ink chambers compared with that in an initial condition, and a step of ejecting ink wherein ink is ejected out of the nozzle holes by deforming to the piezoelectric actuators to reduce the inner volume of each of the ink chambers.

In the second embodiment of the invention, the size of each ink droplet ejected out of the nozzle holes is adjusted by varying a magnitude of a voltage and a length of time for driving the piezoelectric actuators.

A degree of freedom for adjustment can be increased by varying the length of time for driving the piezoelectric actuators as well as the magnitude of the voltage for driving in this way with the following results.

Ink droplets ejected out of the nozzle holes can be adjusted and formed in a required size with ease.

Ink droplets can be ejected steadily at a constant speed regardless of their size, and high speed cycle ejection motions of ink can be coped with without trouble.

In this embodiment of the invention, the step of supplying ink may be divided into two steps, that is, a first ink supply step wherein the piezoelectric actuators are deformed to increase the inner volume of each of the ink chambers compared with that in an initial condition, and a second ink supply step wherein the piezoelectric actuators are deformed to increase the inner volume of each of the ink chambers at a significantly slower speed than for the first ink supply step.

In such a case, the size of each ink droplet ejected out of the nozzle holes may be adjusted by varying the magnitude of the voltage and the length of time for driving the piezoelectric actuator in the second ink supply step.

Furthermore, the driving method according to the second embodiment can be applied to piezoelectric actuators composed of laminated layers, formed by piezoelectric materials and electrodes alternately laminated, and having a piezoelectric strain coefficient $d_{33}$.

In such a case, it is preferable to have the inner volume of each of the ink chambers reduced in an initial condition of the driving operation by applying a voltage to the piezoelectric actuators in the same direction as that of polarization of piezoelectric materials.

In the ink supply step, ink is supplied into the ink chambers by deforming the piezoelectric actuators to increase the inner volume of each of the ink chambers compared with that in an initial condition. The size of each ink droplet ejected out of the nozzle holes is adjusted in the ink supply step by varying the magnitude of a voltage and the length of time for driving the piezoelectric actuators.

After supply of ink into the ink chambers is completed, the driving operation according to the second embodiment proceeds to a step of ejecting ink wherein ink droplets are ejected out of the nozzle holes by deforming the piezoelectric actuators in such a direction as to reduce rapidly the inner volume of each of the ink chambers.

In case of applying the ink supply step described above to the piezoelectric actuators composed of laminated layers, having a piezoelectric strain coefficient $d_{33}$, wherein the ink supply step may be divided into two steps, that is, a first ink supply step of deforming the piezoelectric actuators to increase the inner volume of each of the ink chambers compared with that in an initial condition, and a second ink supply step of deforming the piezoelectric actuators to increase the inner volume of each of the ink chambers linearly at a significantly slower speed than for the first ink supply step, the following is recommended.

That is, in the second ink supply step, a size of each ink droplet ejected out of the nozzle holes may be adjusted by varying a magnitude of a voltage and a length of time for driving the piezoelectric actuators.

In the driving method described above, according to the second embodiment of the invention, it is preferable to increase a voltage to drive the piezoelectric actuators with time during the step of supplying ink into the ink chambers.

Furthermore, it is preferable to substantially equalize a length of time for driving the piezoelectric actuators with a cycle period of natural oscillation of the piezoelectric actuators.

Also, in case that the ink supply step is divided into a first ink supply step and a second ink supply step, it is preferable to increase gradually a voltage to drive the piezoelectric actuators while keeping electric current to the piezoelectric actuator at a constant value in the second ink supply step so that the piezoelectric actuators are deformed at a significantly slower speed than for the first ink supply step.

Further, it is preferable to make the length of time for driving to the piezoelectric actuators nearly equal to an integer times half a cycle period of natural oscillation of the piezoelectric actuators in the first ink supply step or the second ink supply step.

BEST MODE FOR CARRYING OUT THE INVENTION

Figure 1:
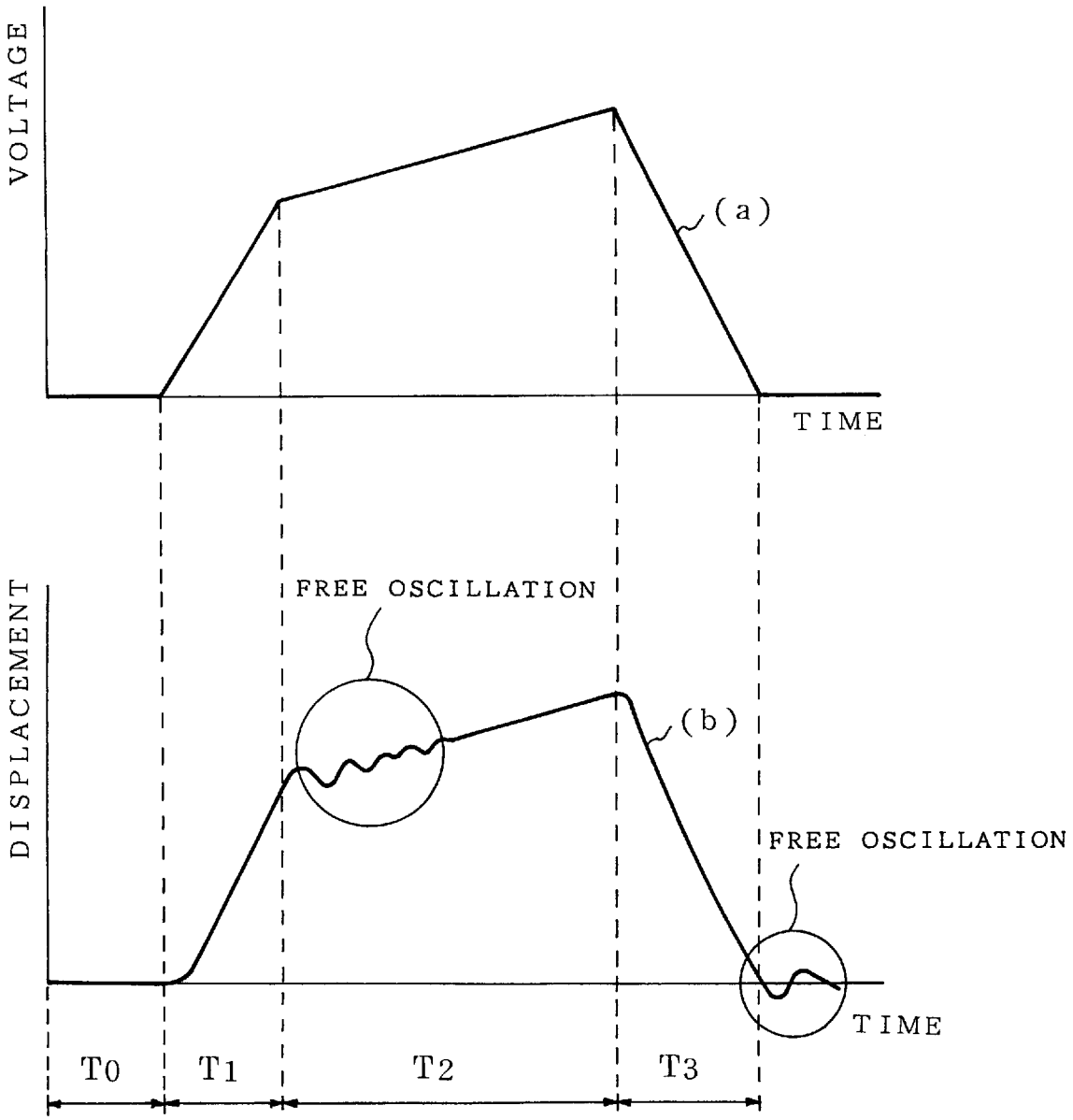
FIG. 1 is a wave form chart for illustrating a method of driving an ink-jet head according to a first embodiment of the present invention.

Referring to the drawings attached, embodiments of a method of driving an ink-jet head according to the invention are described in detail hereafter.

A first embodiment of the present invention is described with reference to FIG. 1 and FIGS. 2A to 2D.

FIG. 1 is a diagram showing a pulse waveform of a voltage applied to a piezoelectric actuator and a displacement waveform of the piezoelectric actuator in connection with the method of driving an ink-jet head according to the first embodiment of the invention. In the figure, a waveform (a) indicates the pulse waveform of the voltage applied to the piezoelectric actuator, and a waveform (b) the displacement waveform of the piezoelectric actuator.

FIGS. 2A to 2D are cross-sectional views showing the piezoelectric actuator and an ink chamber in actuation in respective steps of driving operation according to the first embodiment of the invention.

Figure 2A:
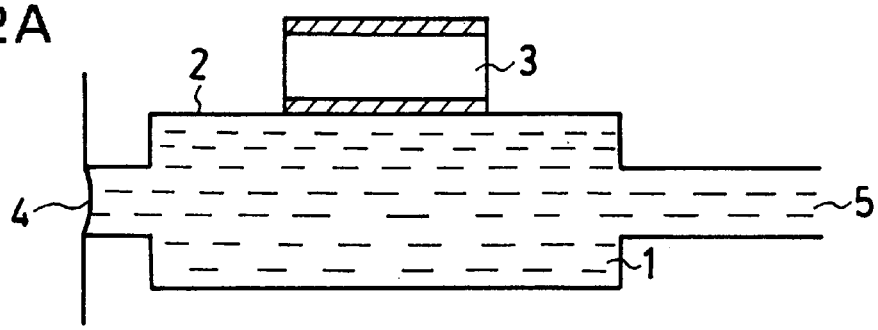
FIG. 2A is a schematic sectional view of an ink-jet head in an initial condition for illustrating the method of driving the ink-jet head according to the first embodiment of the present invention.
Figure 2B:
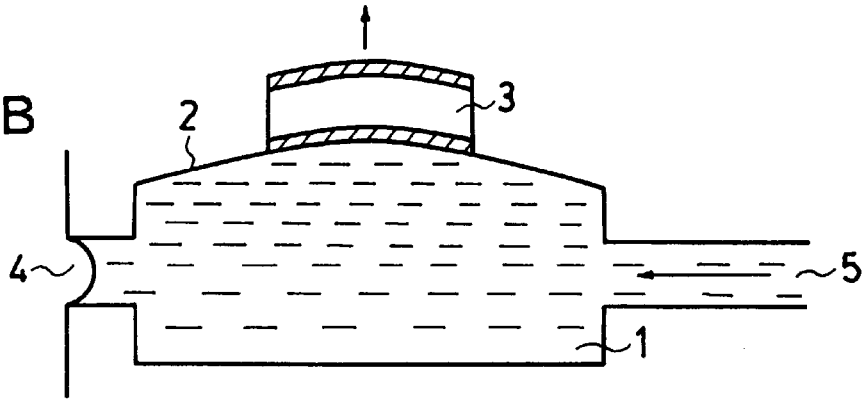
FIG. 2B is a schematic sectional view of the ink-jet head in a first ink supply step for illustrating the method of driving the ink-jet head according to the first embodiment of the present invention.
Figure 2C:
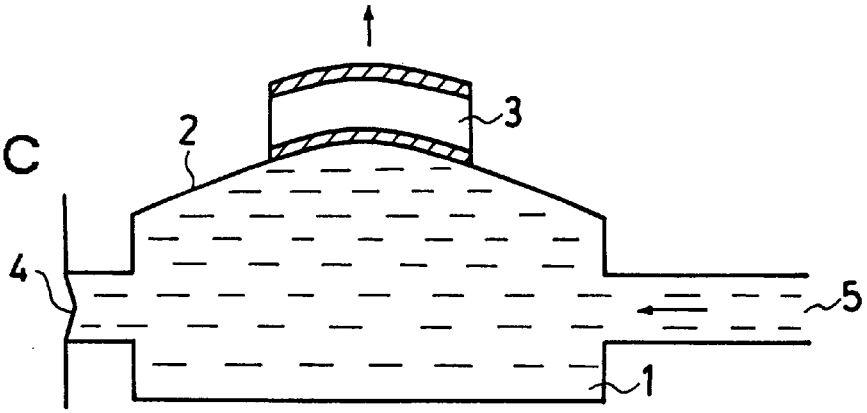
FIG. 2C is a schematic sectional view of the ink-jet head in a second supply step for illustrating the method of driving the ink-jet head according to the first embodiment of the present invention.
Figure 2D:
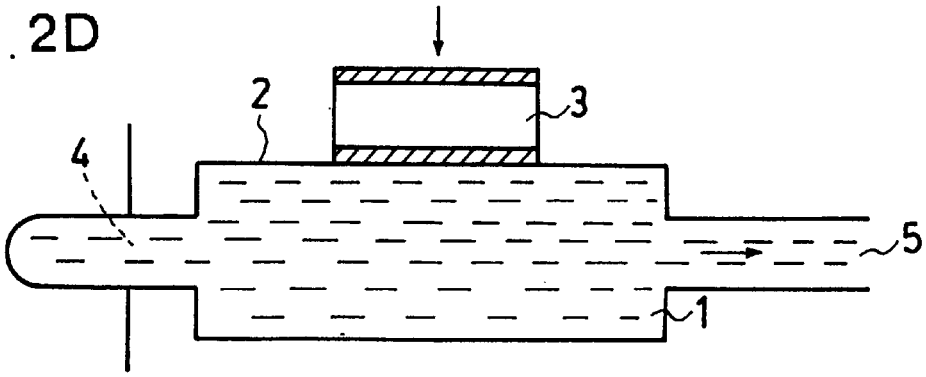
FIG. 2D is a schematic sectional view of the ink-jet head in a step of ejecting ink for illustrating the method of driving the ink-jet head according to the first embodiment of the present invention.

FIG. 2A shows a condition over an interval of time T0 (initial condition) as indicated in FIG. 1, FIG. 2B a condition over an interval of time T1 (first ink supply step) as indicated in FIG. 1, FIG. 2C a condition over an interval of time T2 (second ink supply step) as indicated in FIG. 1, and FIG. 2D a condition over an interval of time T3 (ink ejection step) as indicated in FIG. 1, respectively.

For example, in an ordinary piezoelectric type ink-jet head as shown in FIG. 2A, part of the wall face 2 (the topwall face in the figure) of an ink chamber 1 is provided with a diaphragm and the like, and is freely deformable. A piezoelectric actuator 3 is attached to the freely deformable wall face 2 so that the wall face 2 is deformed by deformation of the piezoelectric actuator 3. The ink chamber 1 leads to a nozzle hole 4 as well as to an ink supply source (not shown) through an ink supply inlet 5.

Over the interval T0, that is, in an initial condition, for example, the piezoelectric actuator 3 is kept unimpressed with a driving voltage (refer to FIG. 2A). In this condition, a meniscus, that is, an interface between ink and air, formed inside the nozzle hole 4, takes a concave shape, maintaining a state of equilibrium.

Subsequently, by applying the driving voltage as shown in FIG. 1 to the piezoelectric actuator 3 over the interval T1 (the first ink supply step), the piezoelectric actuator 3 is deformed in a direction such that an inner volume of the ink chamber 1 is increased compared with that in the initial condition as shown in FIG. 2B. Such deformation of the piezoelectric actuator 3 is accompanied by deformation of the wall face 2 of the ink chamber 1, pulling in the meniscus formed in the nozzle hole 4, and simultaneously, taking ink delivered from the ink supply source (not shown) through the ink supply inlet 5 into the ink chamber 1.

Over the interval T1 (the first ink supply step), ink is supplied to the ink chamber 1 rapidly and steadily. However, when the piezoelectric actuator 3 becomes inactive after the end of the interval T1, free oscillation occurs to ink inside the ink chamber 1 and the meniscus as a result of natural oscillation of the ink being combined with the natural oscillation of the piezoelectric actuator 3.

Over the succeeding interval T2 (the second ink supply step), a driving voltage is applied to the piezoelectric actuator 3 at a slower rate of voltage variation than that over the interval T1. Then, the piezoelectric actuator 3 is deformed in such a direction as to increase the inner volume of the ink chamber 1 at a significantly slower speed than that over the interval T1 (refer to FIG. 2C). In practice, it is possible to deform the piezoelectric actuator 3 slowly by driving the piezoelectric actuator 3 at a constant current value so that its charge current or discharge current is kept constant.

A slow deforming action of the piezoelectric actuator 3 over the interval T2 acts to check amplitudes of the free oscillation that has occurred after the interval T1 (damping action). The oscillation of the ink inside the ink chamber 1 is gradually reduced in amplitude. Such a damping action against the free oscillation of the piezoelectric actuator 3 and the ink becomes particularly pronounced when a length of the interval T2 is nearly equal to an integer times a cycle period of the natural oscillation of the piezoelectric actuator 3.

When a voltage varying in the waveform (a) as shown in FIG. 1 is applied to the piezoelectric actuator 3 over an interval of time T3 (an ink ejection step), the piezoelectric actuator 3 is deformed rapidly in such a direction as to reduce the inner volume of the ink chamber 1 as shown in FIG. 2D. This motion causes the ink chamber 1 to be pressurized rapidly, forcing the meniscus out of the nozzle hole 4, and an ink droplet is formed.

At this time, the amplitude of the free oscillation occurring to the piezoelectric actuator 3 after the interval T3 can be kept small by setting the interval T3 in close proximity of a cycle period of the natural oscillation of the piezoelectric actuator 3 so that driving operation can be repeated at a high cycle.

Now, a second embodiment of the present invention is described in detail hereafter. The second embodiment deals with a method of driving an ink-jet head provided with piezoelectric actuators composed of laminated layers. This embodiment needs to be explained in greater detail than for the first embodiment described above.

Figure 3:
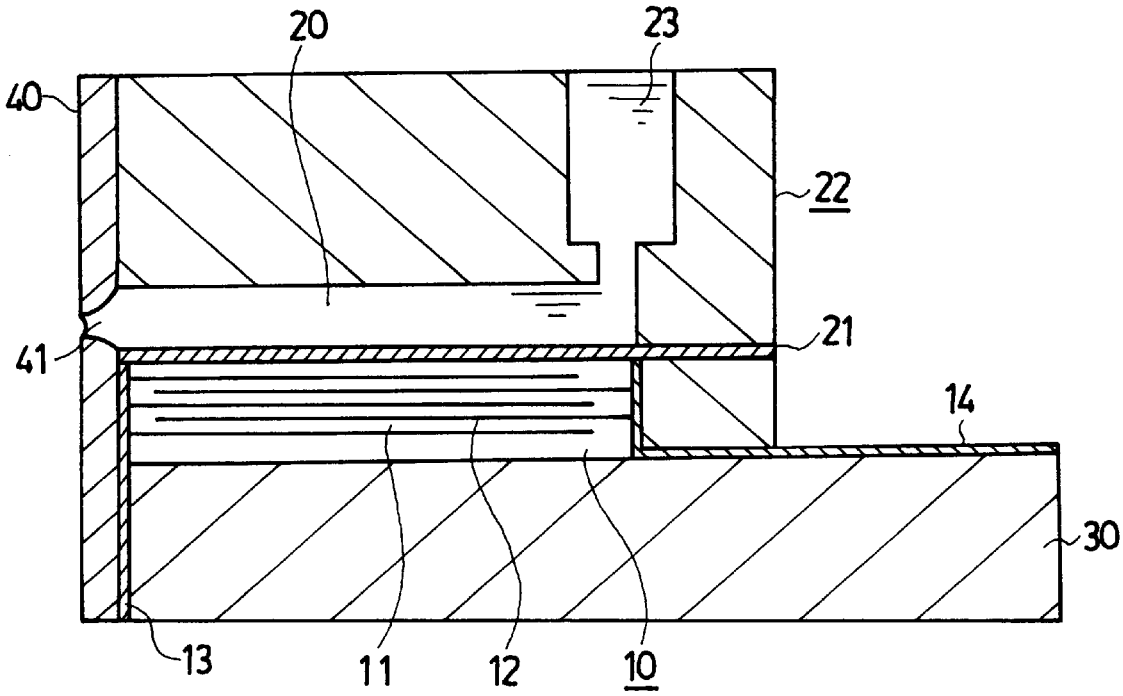
FIG. 3 is a sectional side elevation view of an ink-jet head to which the method of driving an ink-jet head according to a second embodiment of the present invention is applied.
Figure 4:
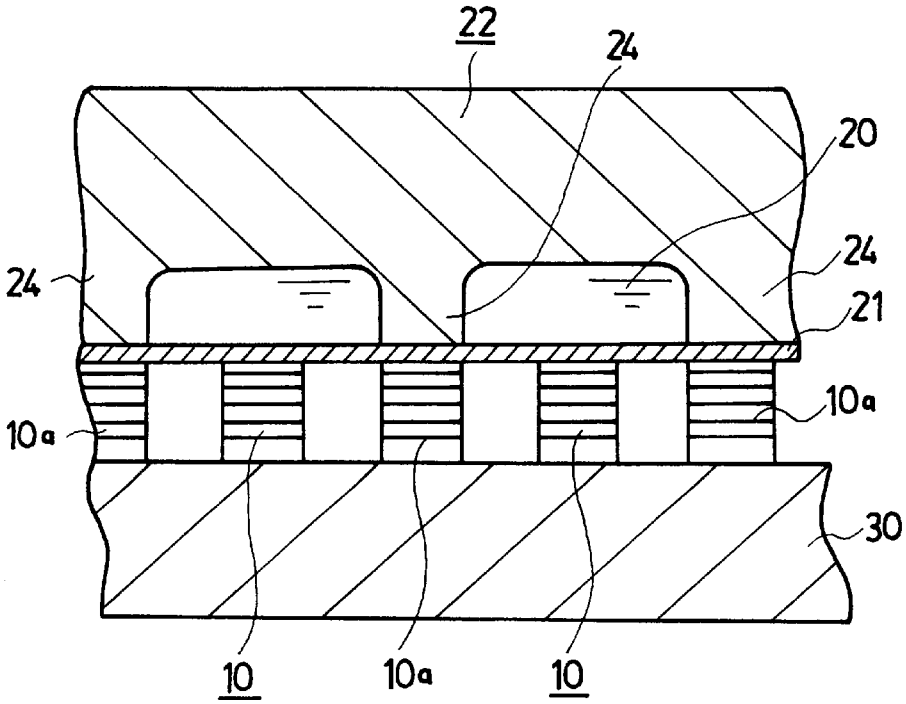
FIG. 4 is a sectional front elevation view of the ink-jet head to which the method of driving the same according to the second embodiment of the present invention is applied.

FIG. 3 is a side elevational sectional view of an ink-jet head to which the driving method according to the second embodiment of the invention is applied, and FIG. 4 a front elevational sectional view of the same.

The ink-jet head has a structure wherein ink chambers 20 are deformed by piezoelectric actuators 10 composed of laminated layers, and having a piezoelectric strain coefficient $d_{33}$. That is, the ink-jet head is provided with a plurality of piezoelectric actuators 10 consisting of piezoelectric materials 11 polarized in the direction of thickness, and conductive materials 12, alternately laminated, and being arranged at predetermined spacings on the surface of a base plate 30 and bonded thereto.

In addition, a collective electrode 13 and a collective electrode 14 are formed respectively on the faces of front and rear ends of the piezoelectric actuators 10 so that the piezoelectric actuators 10 are deformed in the direction of thickness (direction of $d_{33}$) when a voltage is applied between the collective electrode 13 and the collective electrode 14.

A diaphragm 21 thin in thickness is bonded onto the top surfaces of the piezoelectric actuators 10, and a flow path member 22 is bonded onto the top surface of the diaphragm 21. Ink chambers 20 are formed in the flow path member 22 and arranged at predetermined spacings, opposite to each of the piezoelectric actuators 10, with the diaphragm 21 interposed in-between. Each of the ink chambers 20 is provided with an ink supply inlet 23, to which an ink cartridge (not shown) serving as an ink supply source is connected.

The front end faces of the base plate 30 forming the collective electrode 13, the piezoelectric actuators 10, the diaphragm 21, and the flow path member 22, respectively, are flush with each other, and bonded to a nozzle plate 40. The nozzle plate 40 is provided with a plurality of nozzle holes 41, each of which leads to one of the ink chambers 20 formed in the flow path member 22. Thus, when the ink chambers 20 are filled up with ink supplied from the ink cartridge, a meniscus is formed inside each of the nozzle holes 41.

As shown in FIG. 4, the piezoelectric actuators 10 arranged in parallel with each other and bonded onto the top surface of the base plate 30 are disposed such that every second one thereof is faced with each of partitions 24 formed between the ink chambers 20 in the flow path member 22 so that the piezoelectric actuators 10*a* disposed opposite to the partitions 24 are not used for driving, but serve merely as supporting columns.

Figure 5:
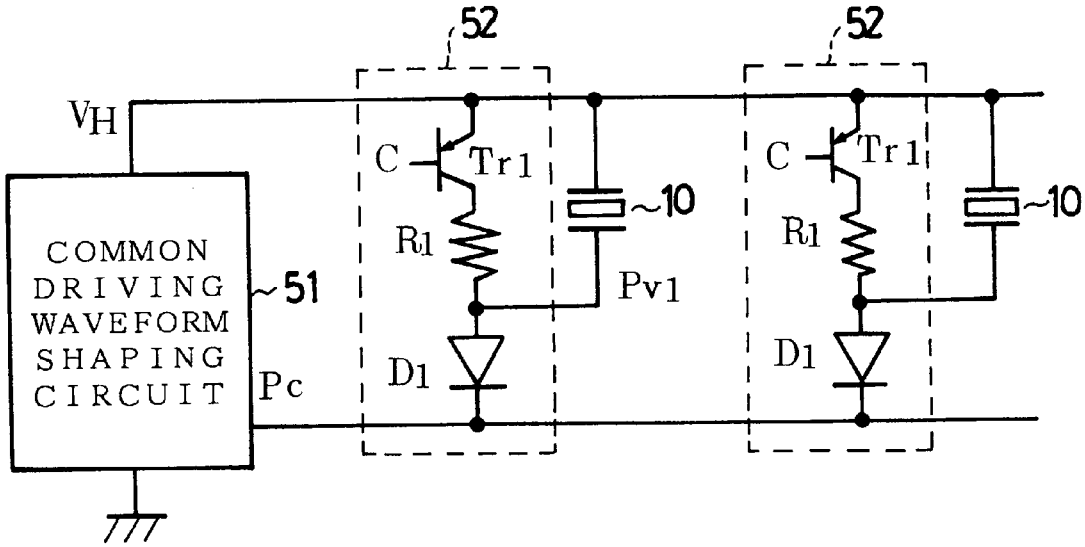
FIG. 5 is a circuit diagram showing a driving circuit for applying a voltage to piezoelectric actuators as shown in FIG. 3.

FIG. 5 is a circuit diagram showing a form of a driving circuit for applying a voltage to the piezoelectric actuators 10 of the ink-jet head described above.

The driving circuit is composed of two circuit blocks, one being a common driving waveform shaping circuit 51, and the other being piezoelectric actuator driving circuits 52 and 52. Each of the piezoelectric actuator driving circuits 52 comprises a switching transistor Tr1 for driving the piezoelectric actuators (referred to merely as "transistor" hereinafter), a resistor R1 for adjusting a discharge time constant, and a diode D1.

An output voltage Pc of the common driving waveform shaping circuit 51 is applied to a cathode side of the diode D1 while an anode side of the diode D1 is connected to one of the terminals of the resistance R1 for adjusting a discharge time constant, and to the collective electrode 13 provided on one end of the piezoelectric actuators 10. The other terminal of the resistor R1 for adjusting a discharge time constant is connected to a collector of the transistor Tr1.

An emitter of the transistor Tr1 and the other collective electrode 14 of the piezoelectric actuators 10 are connected to a driving power source VH. A driving signal to the piezoelectric actuators 10 is outputted to a base of the transistor Tr1.

In the second embodiment of the present invention, the ink-jet head as shown in FIGS. 3 and 4 is driven through the driving circuits as shown in FIG. 5.

Figure 6:
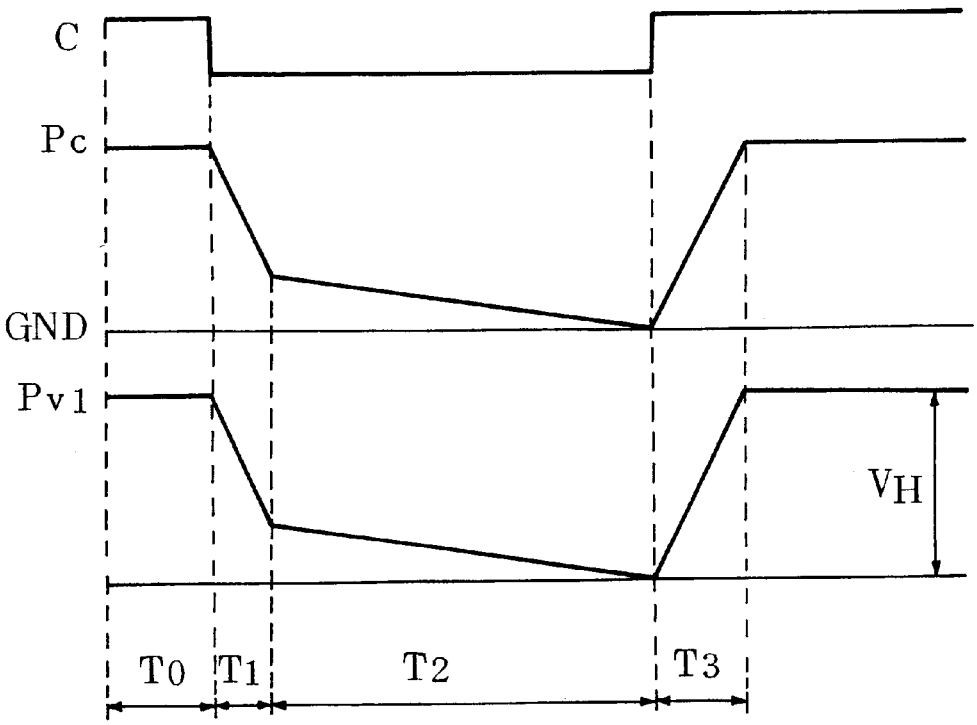
FIG. 6 is a wave form chart for describing the second embodiment of the present invention.

FIG. 6 is a wave form chart illustrating the method of driving the ink-jet head according to the second embodiment of the invention. More specifically, the figure shows a waveform of the driving signal C sent out to the transistor Tr1 in the driving circuits as shown in FIG. 5, a waveform of an output voltage Pc of the common driving waveform shaping circuit 51, and a waveform of a driving voltage Pv1 applied to the piezoelectric actuators 10.

Over an interval of time T0, that is, in an initial condition, the driving signal C is at a "high" level, and the transistor Tr1 as shown in FIG. 5 is in an "off" condition. The output voltage Pc of the common driving waveform shaping circuit 51 provides a bias voltage at the same level as that of a voltage of the driving power source VH, and the piezoelectric actuators 10 are always charged with the bias voltage described above.

Hereupon, the piezoelectric actuators 10 as shown in FIGS. 3 and 4 are expanded in the direction of $d_{33}$, that is, the direction of thickness by the effect of an electric field, the direction of which is the same as that in case of polarization of the piezoelectric actuators 10. Consequently, the diaphragm 21 forming the bottom of the ink chambers 20 is deformed in such a direction as to reduce the inner volume of each of the ink chambers 20, and maintains such a condition.

Then, over an interval of time T1 (a first ink supply step), the driving signal C comes down to a "low" level, and the transistor Tr1 as shown in FIG. 5 is turned "on". As soon as such changeover of the driving signal C takes place, the output voltage Pc of the common driving waveform shaping circuit 51 drops rapidly during the interval T1.

As a result, electric charge that has built up by then in the piezoelectric actuators 10 as shown in FIGS. 3 and 4 is rapidly discharged via the resistor R1 that adjusts a discharge time constant. Such discharge is accompanied by rapid deformation of the piezoelectric actuators 10 in such a direction as to increase the inner volume of each of the ink chambers 20.

Then, ink is rapidly supplied from the ink supply source (not shown) via the ink supply inlet 23 to the ink chamber 20. Such rapid motion of the piezoelectric actuators 10 causes free oscillation to occur to the piezoelectric actuators 10 at the natural oscillation thereof, and simultaneously, rapid supply of ink causes free oscillation frequency to occur to the ink itself in the ink chambers 20.

Subsequently, over an interval of time T2 (a second ink supply step) as shown in FIG. 6, the output voltage Pc of the common driving waveform shaping circuit 51 drops at a slower rate than that for the interval T1.

Accordingly, electric charge that has built up in the piezoelectric actuators 10 as shown in FIGS. 3 and 4 is gradually discharged via the resistor R1 that adjusts a discharge time constant. Such discharge is accompanied by slower deformation of the piezoelectric actuators 10 in such a direction as to increase the inner volume of each of the ink chambers 20.

The free oscillation that occurred by the rapid deformation of the piezoelectric actuators 10 still remains in the piezoelectric actuators 10 after the interval T1 as indicated in FIG. 6, but is damped by the slower deformation taking place over the interval T2 as described above. After the interval T1 as indicated in FIG. 6, free oscillation occurs to the ink in the ink chambers 20 as well. However, such oscillation is also damped in the course of the interval T2. The effect of such damping action against free oscillation as described above is seen particularly pronounced by substantially setting a length of the interval T2 with an integer times a cycle period of the natural oscillation of the piezoelectric actuators 10.

Over an interval of time T3 (an ink ejection step) as indicated in FIG. 6, the driving signal C gets up to a "high" level, and the transistor Tr1 as shown in FIG. 5 is turned "off". Also, as soon as changeover of the driving signal C takes place, the output voltage Pc of the common driving waveform shaping circuit 51 goes up rapidly in the course of the interval T3.

Hereupon, the piezoelectric actuators 10 are rapidly charged with electric charge via the resistor R1 that adjusts a discharge time constant. Such charging is accompanied by rapid deformation of the piezoelectric actuators 10 in such a direction as to reduce the inner volume of each of the ink chambers 20. As a result, ink droplets are ejected out of the nozzle holes 41.

Test 1

The inventors conducted the following test using the ink-jet head of the structure as shown in FIGS. 3 and 4 to determine an optimum length of the interval $T_3$ for damping free oscillation occurring to the ink in the ink chamber 20 after the interval $T_3$ (an ink ejection step). A cycle period of the natural oscillation of the piezoelectric actuators 10 used for the test was about 12 $\mu$s under a condition that the ink chambers 20 are filled up with ink.

Further, the diameter of each of the nozzle holes 41 was $\phi$ 40 $\mu$m, and the inner volume of each of the ink chambers 20 was 0.15 $mm^3$. The ink used for the test had viscosity of 3.1 cp, and surface tension of 43 dyn/cm.

Figure 7:
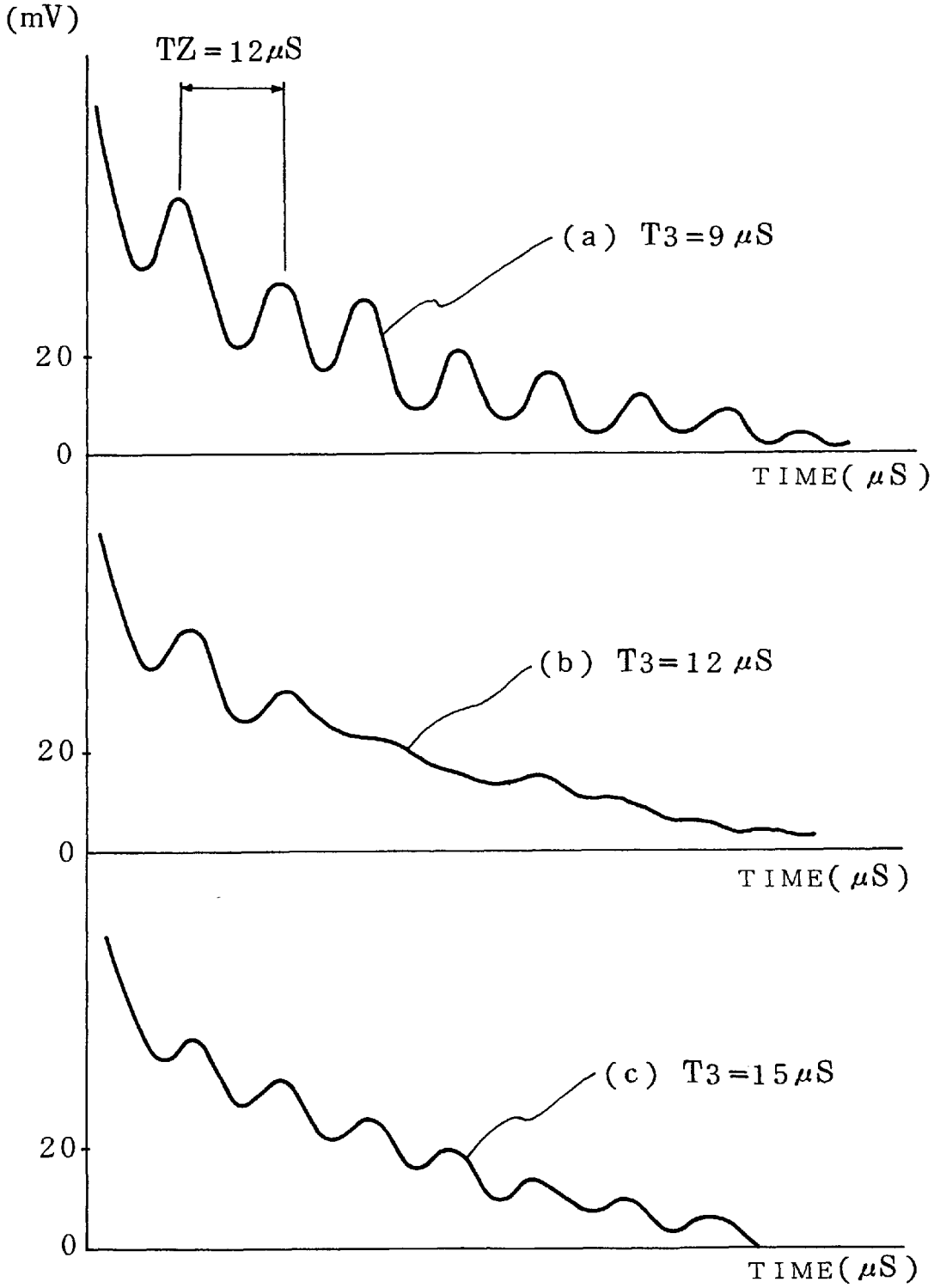
FIG. 7 is a chart showing data on the results of a first test carried out on the basis of the second embodiment.

In the test, the length of the interval T3 for the ink ejection step as indicated in FIG. 6 was set at 9 $\mu$s, 12 $\mu$s, and 15 $\mu$s, respectively. Residual free oscillation still remaining in the ink inside the ink chambers 20 was converted into the electromotive force of a monitoring actuator, and detected. The results thereof are shown in FIG. 7. In the figure, a curved line (a) indicates the test result when T3 is set at 9 μs, a curved line (b) when T3 is set at 12 μs, and a curved line (c) when T3 is set at 15 μs, respectively.

It is apparent from FIG. 7 that the free oscillation of the ink is damped most rapidly when the interval T3 is substantially equal to a cycle period of the natural oscillation of the piezoelectric actuators, that is, T3=12 μs.

Test 2

Using an ink-jet head of the structure as shown in FIGS. 3 and 4, the inventor of the present invention et al. conducted a second test on the effect of a driving frequency of the ink-jet head, that is, a number of cycles of repetitive ink ejection motions occurring per unit of time, according to the driving method of the invention.

This test was carried out under a condition that the ink-jet head used for the test was the same as that used for the first test in respect to the diameter of each of the nozzle holes, the inner volume of each of the ink chambers, and the viscosity and the surface tension of the ink.

Figures 8, 9:
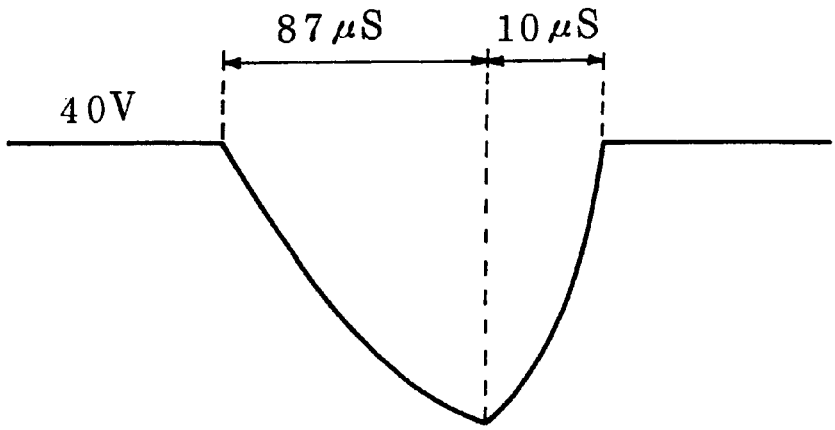
FIG. 8 is a table showing data on the results of a second test carried out on the basis of the second embodiment and the data on a comparative example 1.
FIG. 9 is a wave form chart showing the driving waveform of piezoelectric actuators in the comparative example 1.

The ink-jet head was repeatedly driven at various driving frequencies as shown in FIG. 8 by setting at Va=15V, Vb=24V, T1=12 μs, T2=72 μs, and T3=12 μs with reference to the driving voltage Pv 1 in the waveform as indicated in FIG. 6. Also, ejection speeds of ink droplets at respective driving frequencies were measured. The test was conducted by making adjustment such that ink droplets of Ø=50 μm were formed.

As is apparent from FIG. 8, the ink-jet head was driven by the driving method according to the invention without any trouble at driving frequencies ranging from 0.25 KHz at low speed driving to 10 KHz at high speed driving, attaining a nearly constant ejection speed of ink droplets (around 5.0 m/s) regardless of varying driving frequencies.

The performance described above is considered due to the effect of the unique driving method according to the present invention whereby ink is supplied rapidly in the first supply step, and then, in the second ink supply step and the ink ejection step, the free oscillation of the piezoelectric actuators and the ink itself is effectively damped.

Comparative Example 1

Using a similar ink-jet head and ink as those used for the second test described above, another test on the effect of driving frequencies of the ink-jet head was conducted in a manner similar to that for the second test. In the case of the comparative example 1, the piezoelectric actuators 10 were driven at the driving voltage varying in a waveform as shown in FIG. 9. Specifically, with reference to the driving waveform indicated in FIG. 9, ink was supplied to the ink chambers for the first 87 μs, and ink droplets were ejected out of the nozzle holes for the next 10 μs. The test result is given along with that of the second test in FIG. 8.

In the comparative example 1, it was no longer possible to form ink droplets, each ϕ 50 μm in diameter, at a driving frequency of 4 KHz. Hereupon, the test was conducted by setting the diameter of each ink droplet at ϕ 30 μm for driving at a frequency of 4 KHz or higher. However, it turned out that it was impossible to eject ink droplets properly at a driving frequency of 8 KHz or higher.

The inventors have confirmed that the free oscillation of the piezoelectric actuators 10 and ink itself is damped in the first ink supply step by substantially making the length of the interval T1 for carrying out the first ink supply step equal to a cycle of the natural oscillation of the piezoelectric actuators 10, thereby further enhancing the responsiveness of the ink-jet head.

Furthermore, the inventors have confirmed that it is preferable to apply a constant current driving method whereby a driving voltage is gradually varied while keeping current at a constant value to the second ink supply step wherein the free oscillation that has occurred to the piezoelectric actuators 10 and ink itself in the first ink supply step is damped, and said free oscillation is nearly eliminated in a period of several times the cycle of the natural oscillation of the piezoelectric actuators 10.

Now, a method of driving an ink-jet head according to a third embodiment of the invention is described in detail hereafter.

The driving method according to the third embodiment of the invention is to drive the ink-jet head as shown in FIGS. 3 and 4 through the driving circuit as shown in FIG. 5.

Figure 10:
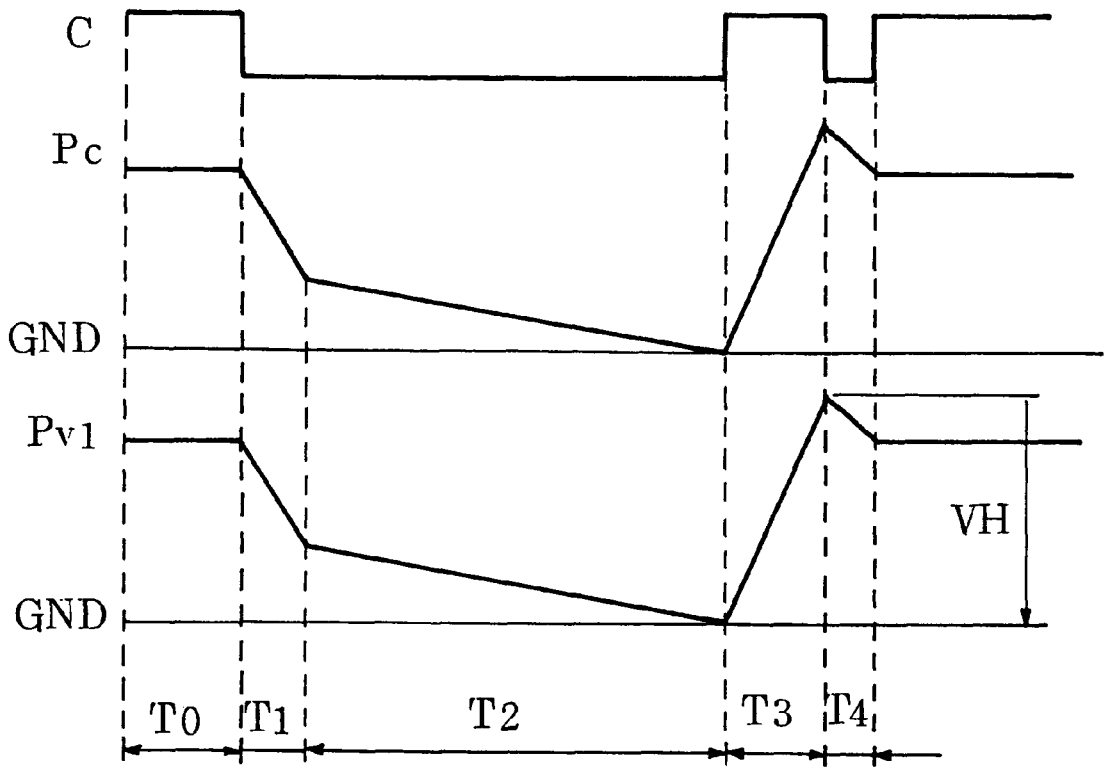
FIG. 10 is a wave form chart for illustrating a third embodiment according to the invention.

FIG. 10 is a wave form chart illustrating the method of driving the ink-jet head according to the third embodiment of the invention. Specifically, the figure indicates a waveform of the driving signal C sent to the transistor Tr1, a waveform of the output voltage Pc of the common driving waveform shaping circuit 51, and a waveform of the driving voltage Pv 1 applied to the piezoelectric actuators 10, respectively, as indicated in FIG. 5.

Firstly, over an interval of time T0 in an initial condition as shown in FIG. 10, the driving signal C is at a "high" level, and the transistor Tr 1 as shown in FIG. 5 is in the "off" condition. The output voltage Pc of the common driving waveform shaping circuit 51 provides a bias voltage at a level lower than the voltage of the driving power source VH, and the piezoelectric actuators 10 are always charged with the bias voltage described above.

At this point in time, the piezoelectric actuators 10, shown in FIGS. 3 and 4, are deformed in the $d_{33}$ mode, that is, in the direction of thickness by the effect of an electric field, the direction which is the same as that of polarization of the piezoelectric actuators 10. As a result, a diaphragm 21 forming the bottom wall of the ink chambers 20 is deformed in a direction to reduce the inner volume of each of the ink chambers 20, and maintains such a condition.

Over an interval of time T1 (a first ink supply step) as shown in FIG. 10, the driving signal C comes down to a "low" level, and the transistor Tr 1 as shown in FIG. 5 is in the "on" condition. As soon as the changeover of the driving signal C takes place, the output voltage Pc of the common driving waveform shaping circuit 51 drops rapidly in the course of the interval T1.

Accordingly, electric charge that has built up in the piezoelectric actuators 10 is rapidly discharged through the resistor R1 that adjusts a discharge time constant. Such discharging is accompanies by rapid deformation of the piezoelectric actuators 10 to increase the inner volume of each of the ink chambers 20. Consequently, ink is rapidly supplied into the ink chambers 20 from an ink supply source (not shown) via the ink supply inlet 23.

Hereupon, free oscillation at the cycle of the natural oscillation of the piezoelectric actuators 10 occurs to the piezoelectric actuators 10 by such rapid deformation as described above, and at the same time, free oscillation of the ink inside the ink chambers 20 by rapid supply of ink.

Subsequently, over an interval of time T2 (a second ink supply step), the output voltage Pc of the common driving waveform shaping circuit 51 shown in FIG. 5 comes down at a slower rate than for the same over the interval T1.

Accordingly, electric charge that has built up in the piezoelectric actuators 10 is gradually discharged through the resistor R1 that adjusts a discharge time constant. Such discharging is accompanied by slow deformation of the piezoelectric actuators 10 to increase the inner volume of each of the ink chambers 20.

Hereupon, the free oscillation of the piezoelectric actuators 10 that occurs by the motion of the piezoelectric actuators 10 over the interval T1 is damped by slow deformation thereof occurring over the interval T2. Similarly, the free oscillation of the ink itself is also damped over the interval T2. Such damping action against these free oscillations is particularly pronounced by substantially equalizing a length of the interval T2 with an integer times the cycle of the natural oscillation of the piezoelectric actuators 10.

Subsequently, over an interval of time T3 (an ink ejection step), the driving signal C gets up to a "high" level, and the transistor Tr 1 as shown in FIG. 5 is in the "off" condition. As soon as the changeover of the driving signal C takes place, the output voltage Pc of the common driving waveform shaping circuit 51 rises rapidly up to the voltage of the driving power source VH in the course of the interval T3.

Accordingly, the piezoelectric actuators 10 are rapidly charged with electric charge via the resistor R1 that adjusts a discharge time constant. Such charging is accompanied by rapid deformation of the piezoelectric actuators 10 in such a direction as to reduce the inner volume of each of the ink chambers 20. As a result, ink droplets are ejected out of the nozzle holes 41.

Then, over an interval of time T4 (a restoration step) as shown in FIG. 10, the driving signal C comes down to a "low" level again, and the transistor Tr 1 is in the "on" condition. As soon as the changeover of the driving signal C takes place, the output voltage Pc of the common driving waveform shaping circuit 51 comes down to the bias voltage from the voltage of the driving power source VH in the course of the interval T4.

In the driving method described above according to the third embodiment of the invention, an initial bias voltage can be set at a low level. Therefore, leakage current from the electrodes of the piezoelectric actuators 10 can be minimized even in a highly moist ambience or when the ink-jet head is out of use for a long period.

The driving frequency characteristic of this embodiment is substantially the same as that of the second embodiment of the invention described above.

Although the piezoelectric actuator composed of laminated layers was used in carrying out the second and third embodiments described above, the similar effect of the driving method according to the invention is obtained when it is applied to a piezoelectric actuator of a Kaiser type or a share-mode type.

The method of driving an ink-jet head according to a fourth embodiment of the invention is described in detail hereafter.

Figure 11:
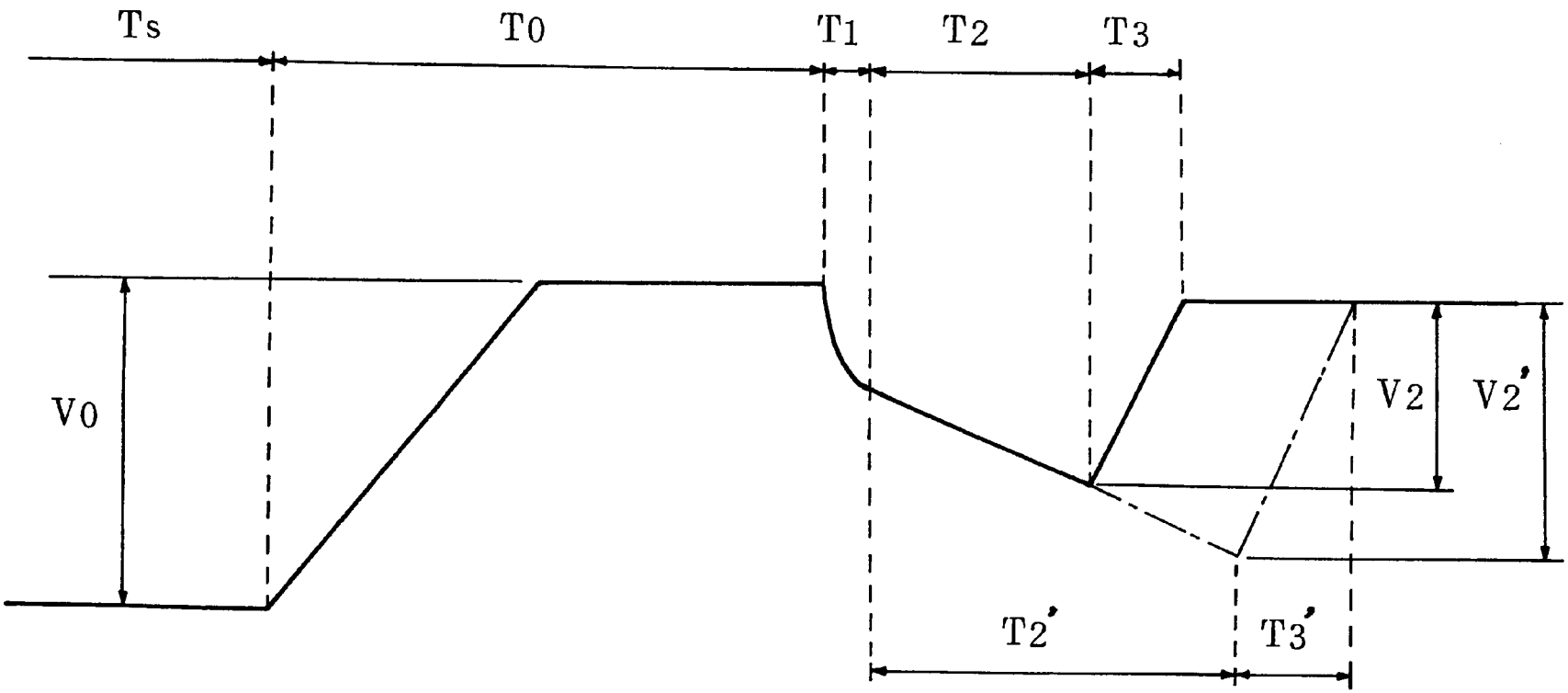
FIG. 11 is a wave form chart for illustrating a fourth embodiment according to the invention.

FIG. 11 is a wave form chart showing the driving voltage applied to the piezoelectric actuator.

In this embodiment of the invention, a size of each ink droplet ejected out of the nozzle holes is adjusted by varying a magnitude of a voltage applied to the piezoelectric actuators and a time for applying the voltage in the second ink supply step according to the second embodiment of the invention described above. In the driving method according to the fourth embodiment of the invention, the ink-jet head as shown in FIGS. 3 and 4 is driven through the driving circuit as shown in FIG. 5.

Starting from an interval of time Ts as shown in FIG. 11, when a voltage is not yet applied to the piezoelectric actuators 10 as shown in FIGS. 3 and 4, a voltage is slowly applied thereto in the direction of polarization thereof over an interval of time T0 such that the piezoelectric actuators 10 are deformed in a direction to reduce the inner volume of each of ink chambers, thus setting up an initial condition.

An amount of deformation in the direction of the thickness $\delta\chi$ of each of the piezoelectric actuators 10 varies in proportion to the piezoelectric strain coefficient $d_{33}$, an applied voltage Vo, and the number n of plate-shaped piezoelectric material layers as expressed by the following formula:

$$\delta\chi = n \times d_{33} \times Vo$$

The inventors conducted a test wherein the amount of deformation in the direction of the thickness ($\delta\chi$=0.5 $\mu$m) was achieved in an initial condition by applying a voltage Vo=40V over the interval T0 to the piezoelectric actuators each having the piezoelectric strain coefficient $d_{33}=600\times10^{-12}$ m/v and composed of n (n=20) layers of plate-shaped piezoelectric material.

This means that, on the basis of a width and length of each of the piezoelectric actuators as shown in FIGS. 3 and 4 being 0.1 mm and 4 mm, respectively, the inner volume of each of the ink chambers 20 was reduced by $2\times10^{-13}$ $m^3$ in the initial condition from that in the interval Ts, which was maintained throughout the interval of time T0.

Subsequently, over an interval of time T1 (a first ink supply step) as shown in FIG. 11, electric charge that has built up in the piezoelectric actuators 10 is discharged by a command for printing, restoring the predeformation shape of the piezoelectric actuators 10. A length of the interval T1 is set very short in the range from several $\mu$s to several tens of $\mu$s so that the piezoelectric actuators 10 are rapidly deformed in a direction to increase the inner volume of each of the ink chambers 20.

A discharge curve in this instance is dependent on a CR time constant which is determined by capacitance and electric resistance of the piezoelectric actuators 10 as shown in FIGS. 3 and 4 as well as by electric resistance of the driving circuits as shown in FIG. 5.

In carrying out this embodiment of the invention, a deformation amount of each of the piezoelectric actuators 10 is set to decrease over the interval T1 by a percentage according to the CR time constant, ranging from 20 to 50% from that of the initial condition. It follows that the inner volume of each of the ink chambers 20 is increased by 20 to 50% from that in the initial condition. Ink is supplied into the ink chambers 20 from the ink supply source (not shown) via the ink supply inlets 23 due to such increase in the inner volume of each of the ink chambers 20.

Then, over an interval T2 (a second ink supply step) as shown in FIG. 11, the piezoelectric actuators 10 are deformed in a direction to increase the inner volume of each of the ink chambers 20 by discharging electric charge that has built up in the piezoelectric actuators 10. Such deformation is accompanied by further supply of ink into the ink chambers 20 from the ink supply source (not shown). A length of the interval T2 is set to be sufficiently longer than that of the interval T1 so that the electric charge accumulated in the piezoelectric actuators 10 is linearly discharged at a slow speed.

Then, over an interval T3 (an ink ejection step) as shown in FIG. 11, the inner volume of each of the ink chambers 20 is rapidly reduced by rapidly charging the piezoelectric actuators 10. As a result, the internal pressure of the ink chambers 20 rises rapidly, ejecting ink droplets out of nozzle holes 41.

A size (cubic volume) of each ink droplet is proportional to an amount of ink supplied into the ink chamber 20 in the first and second ink supply steps. The amount of ink supplied is dependent on a magnitude of the driving voltage applied to the piezoelectric actuators 10 and a length of time for applying the voltage.

In this connection, when only the driving voltage applied to the piezoelectric actuators 10 is varied, the amount of ink supplied is changed according to the magnitude of the driving voltage, however, the time is proportional to the amount of ink is required to fill the ink chambers 20 up with ink. Accordingly, the condition of residual oscillation of the ink in the ink chambers 20 immediately after completion of the ink supply step varies depending on the amount of the ink supplied.

More specifically, in case of a small amount of ink being supplied, the ink is ejected in a condition wherein the residual oscillation has subsided, while in case of a large amount of ink being supplied, the ink is ejected in a condition wherein the residual oscillation of large amplitude still remains. When the ink is ejected in varying conditions wherein the oscillating condition is shifting, the ejection speed of the ink droplets becomes unstable.

Therefore, in this embodiment, the amount of ink supplied into the ink chambers 20 is adjusted by varying the driving voltage V2 applied to the piezoelectric actuators 10 as well as the length of the interval T2 for applying the driving voltage. Thus, the amount of ink supplied and the condition of the oscillation occurring to the ink inside the ink chambers 20 during the ink supply step can be adjusted by setting an appropriate length of interval T2 for applying the driving voltage. As a result, ink droplets can be ejected at a constant speed regardless of their size.

Also, in this embodiment, with the length of the interval T1 for the first ink supply step, wherein supply of ink needs to be completed in a short time, being left as it is, the amount of ink supplied is adjusted in a manner described above in the second ink supply step for which a longer time is set. Consequently, the size of each ink droplet can be adjusted with greater ease.

For example, in case that the size of each ink droplet needs to be enlarged, the driving voltage V2 applied to the piezoelectric actuators 10 in the second ink supply step and the length of the interval T2 for applying the voltage may be changed to V2' and T2', respectively, as shown in FIG. 11.

An ink ejection step is executed over an interval T3 as shown in FIG. 11 wherein the inner volume of each of the ink chambers 20 is rapidly reduced by rapidly charging the piezoelectric actuators 10. As a result, the internal pressure of the ink chambers 20 is increased rapidly, ejecting ink droplets out of the nozzle holes 41. When the second ink supply step is executed at the driving voltage V2' over the interval T2', the ink ejection step is executed over an interval of time T3'.

A length of the interval T3 (T3') for the ink ejection step is substantially equal to the cycle of the natural oscillation of the piezoelectric actuators 10 which is dependent on the rigidity and mass of the piezoelectric actuators 10, the inner volume of each of the ink chambers 20 when filled up with ink, and the like. By pushing ink droplets out of the ink chambers 20 at a cycle close to that of the natural oscillation of the piezoelectric actuators 10 as described above, oscillation occurring to the ink inside the ink chambers 20 after ejection of the ink droplets can be controlled to a minimum.

As shown in FIG. 11, as the driving voltage V2' is higher than V2 for ejecting ink droplets of smaller sizes, ink droplets are provided with greater energy in the ink ejection step when the driving voltage V2' is applied. Accordingly, the ink droplets are ejected at a higher speed, enabling the ink droplets even if large in size to reach a recording medium without delay.

Test 3

The inventors conducted a further test to confirm the effect of the driving method according to the fourth embodiment of the present invention, using the ink-jet head of the structure as shown in FIGS. 3 and 4.

Figures 12, 13:
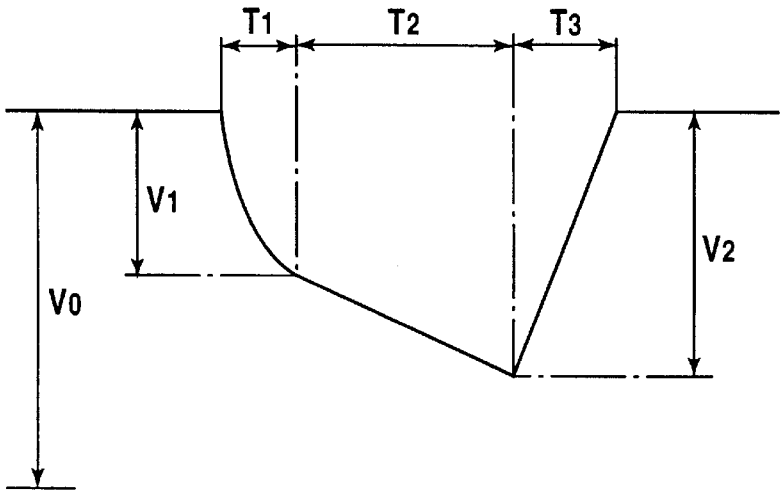
FIG. 12 is a wave form chart showing the driving waveform of piezoelectric actuators used in a third test carried out on the basis of the fourth embodiment.
FIG. 13 is a table showing data on the results of the third test carried out on the basis of the fourth embodiment.

FIG. 12 is a wave form chart illustrating a driving waveform of the piezoelectric actuators used in the test.

In the third test, the size (diameter) of each ink droplet ejected from the nozzle holes and the diameter of each pixel formed by the ink attached onto a recording medium (ordinary paper) were measured by varying the magnitude of the driving voltage V2 applied to the piezoelectric actuators 10 and the length of the interval T2 for applying the voltage in the second ink supply step as shown in the wave form chart.

A voltage V0 applied to the piezoelectric actuators in an initial condition was set at 40V, a voltage V1 applied thereto in the first ink supply step at 12.6V, the length of the interval T1 for the first ink supply step at 15.4 $\mu$s, and the length of the interval T3 for the ink ejection step at 8 $\mu$s.

The ink-jet head used for this test is the same as the one used for the first test. That is, a cycle period of the natural oscillation of the piezoelectric actuators 10 thereof was about 12 $\mu$s, the diameter of each of the nozzle holes was Ø 40 $\mu$m and the inner volume of each of the ink chambers was 0.15 $mm^3$. The ink used for the test had viscosity of 3.1 cp, and surface tension of 43 dyn/cm.

The test was conducted by setting the driving voltage V2 applied to the piezoelectric actuators in the second ink supply step and the length of the interval T2 for applying the voltage at values given in FIG. 13. As a result, various values for the diameter of each ink droplet and each ink pixel as shown in the figure were obtained. The ejection speeds of ink droplets were also given in the figure.

Figure 14:
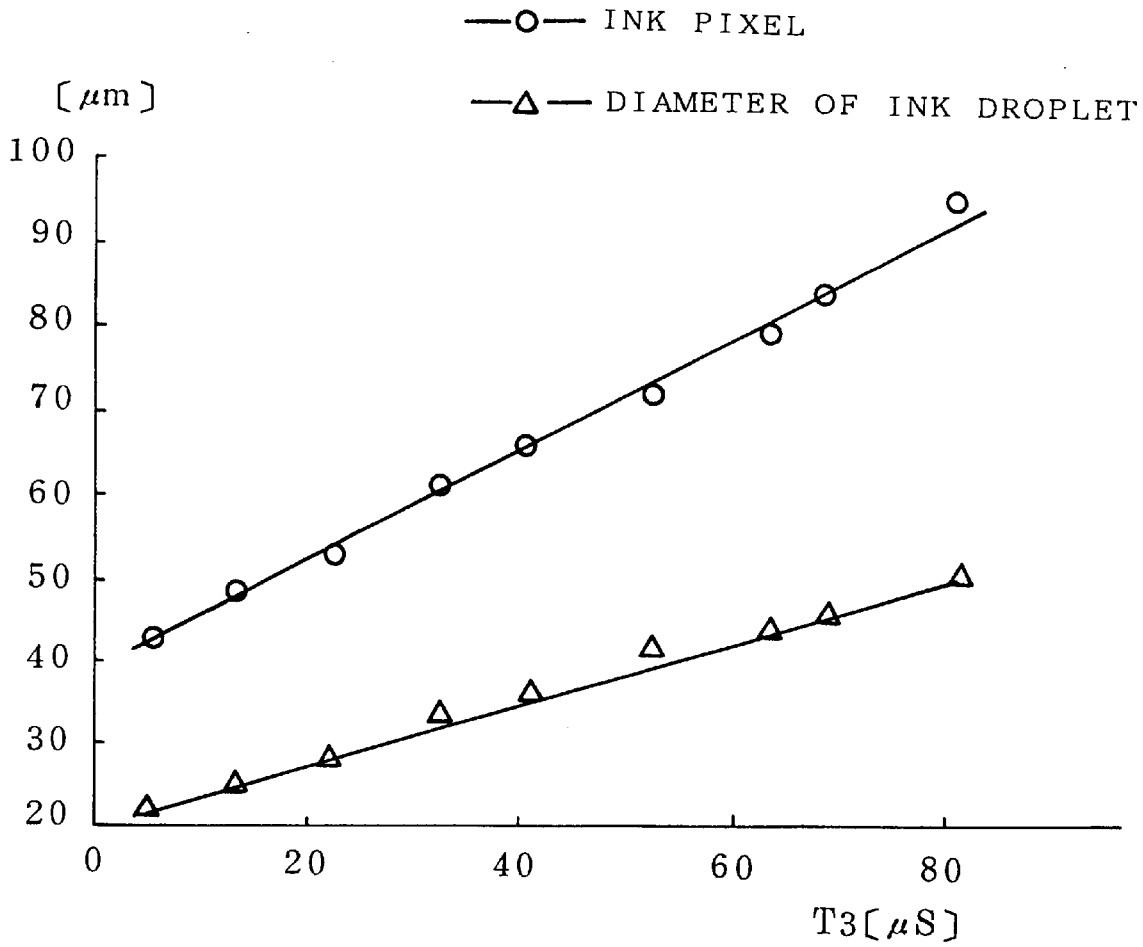
FIG. 14 is a graph plotted with the data as given in FIG. 13.
Figure 14:
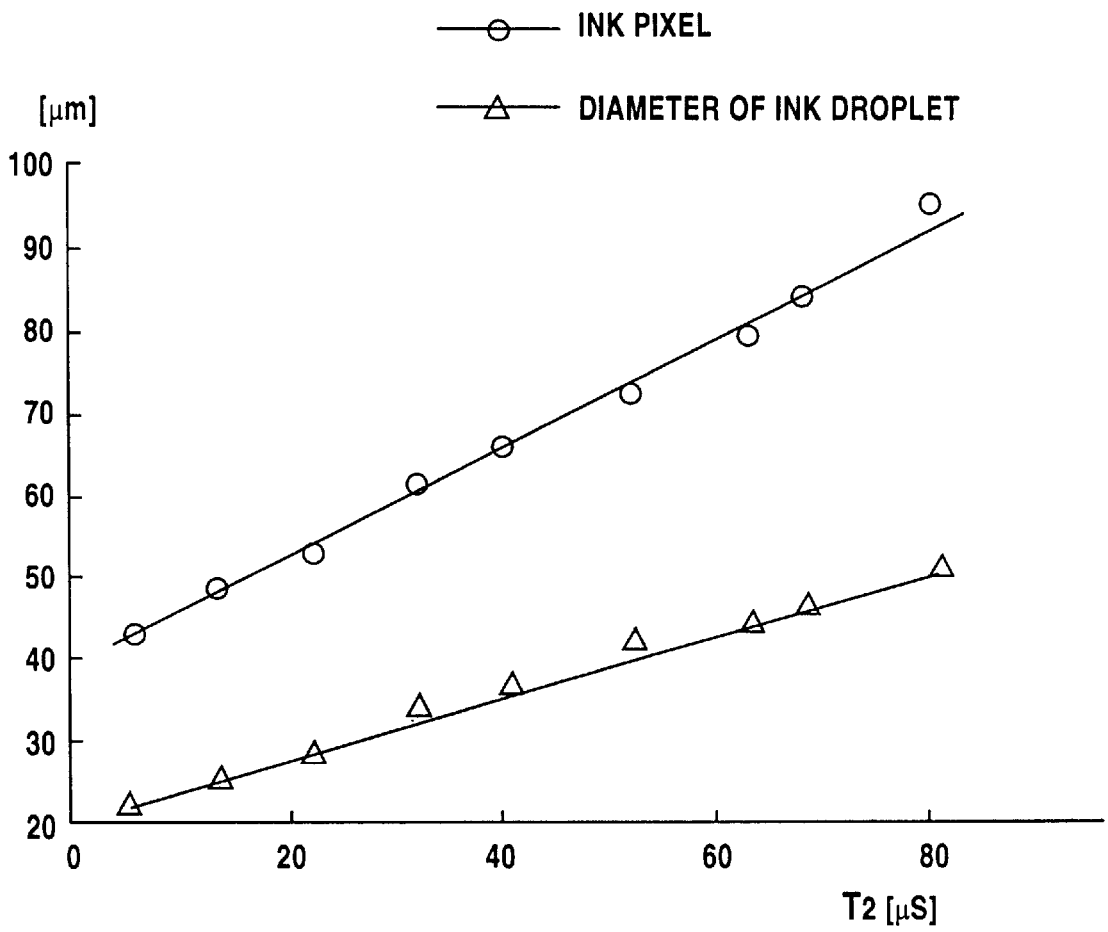
Figure 15:
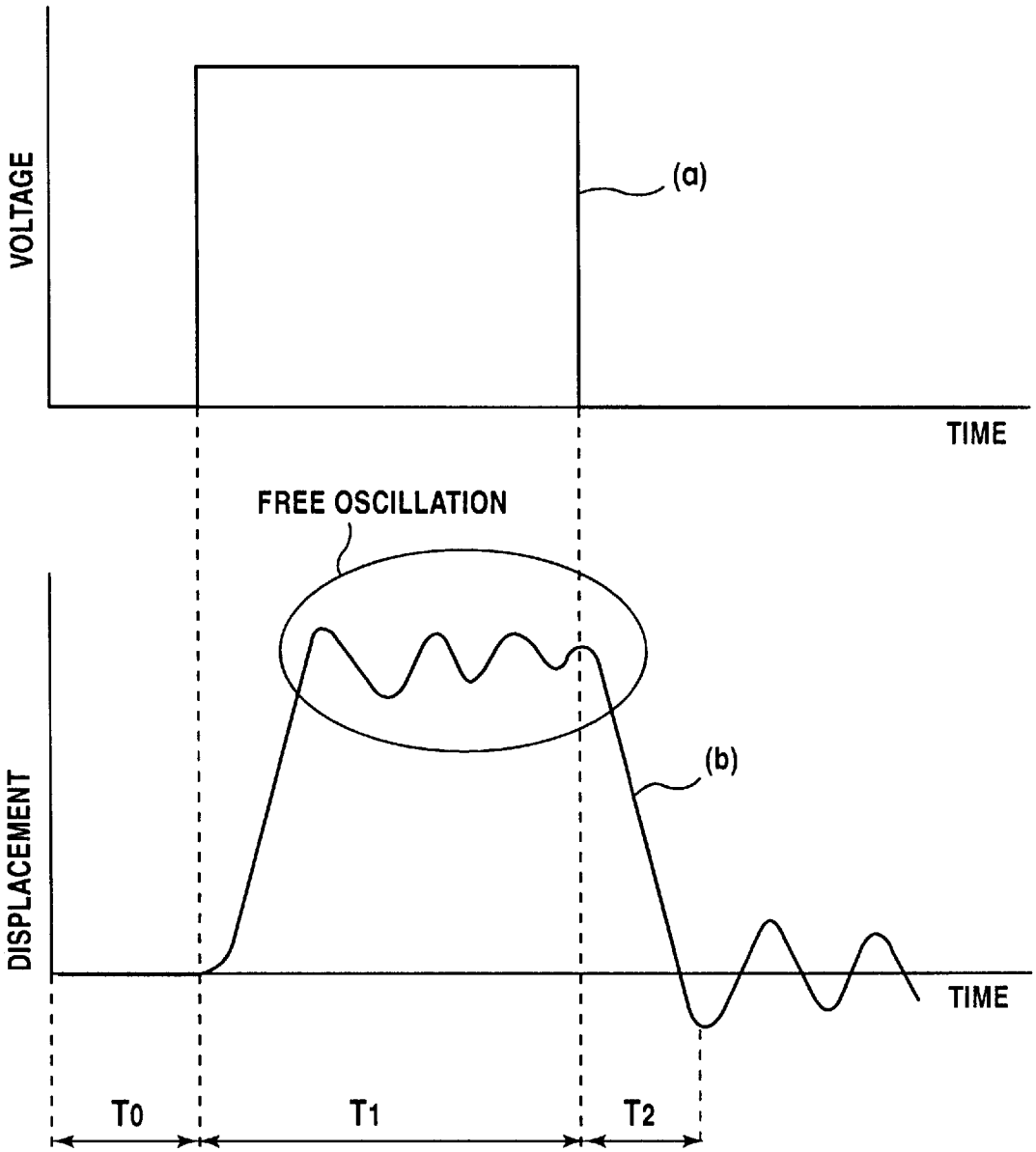
FIG.15 PRIOR ART
FIG. 15 is a wave form chart for illustrating a conventional method of driving an ink-jet head.

FIG. 14 is a graph obtained by plotting with the data given in FIG. 13 showing that the diameter of each ink droplet and each ink pixel could be varied in a substantially linear manner. Also, as shown along with other data in FIG. 13, ink droplets were ejected at a substantially constant speed (around 5.0 m/s) for forming both ink droplets and ink pixels of various diameters.

Furthermore, the method of driving an ink-jet head according to the present invention whereby the size of each ink droplet ejected from respective nozzle holes can be adjusted by varying the magnitude of a voltage applied to the piezoelectric actuators, and the length of time for applying the voltage is applicable to ink-jet heads using piezoelectric actuators other than the laminated layer type ones.

Also, the fourth embodiment of the invention described in the foregoing may be carried out by varying a magnitude of the driving voltage applied to the piezoelectric actuators, and a length of time for applying the voltage in the course of one ink supply step thereof in case of driving an ink-jet head without breaking said ink supply step down into the first ink supply step and the second ink supply step.

Figure 16:
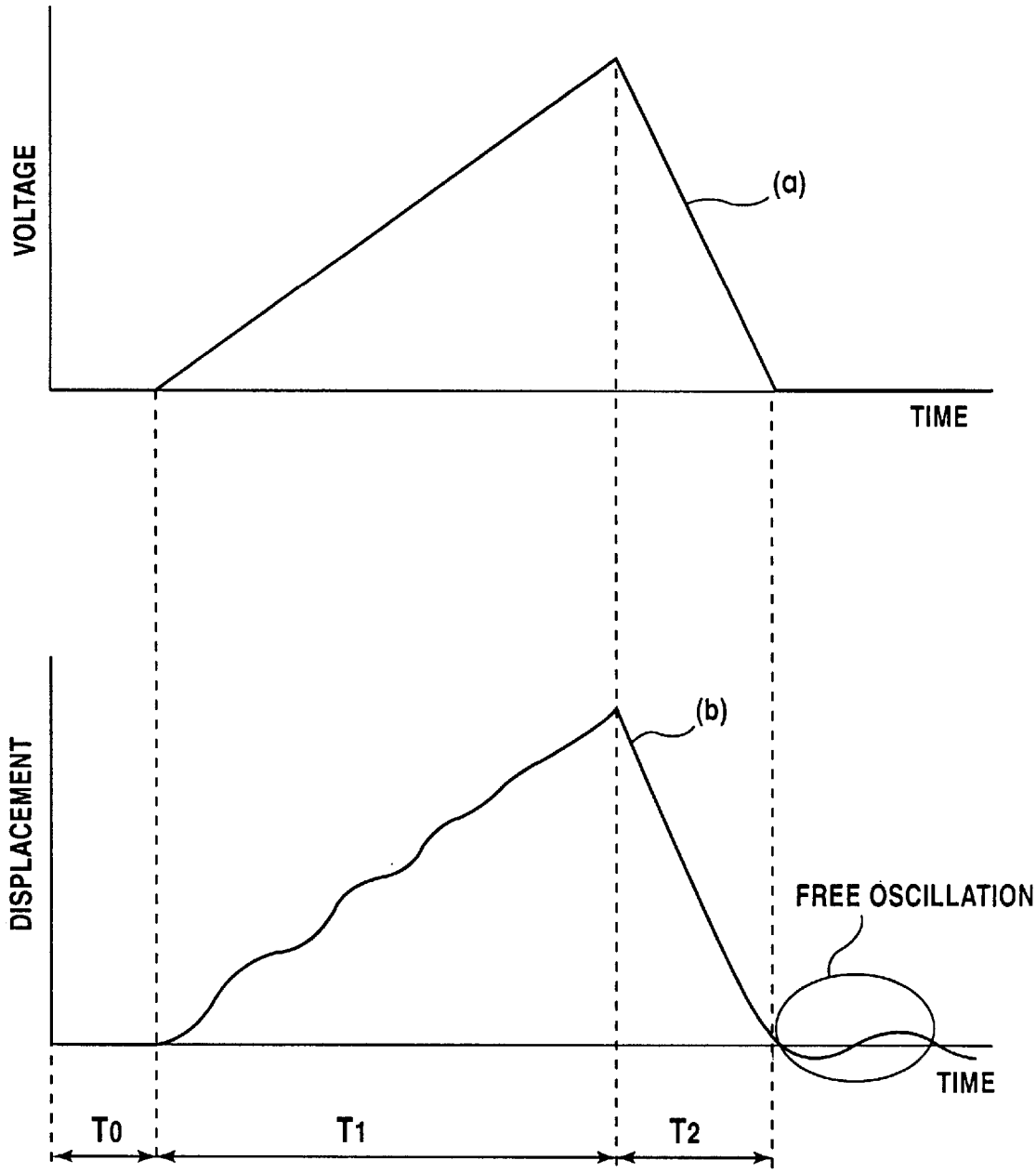
FIG.16 PRIOR ART
FIG. 16 is a wave form chart for illustrating another conventional method of driving an ink-jet head.

Furthermore, in case of ejecting ink through steps starting from an initial condition via an ink supply step to an ink ejection step according to a conventional driving method as shown in FIG. 16, a magnitude of the driving voltage applied to the piezoelectric actuators and a length of time for applying the voltage may be varied in the ink supply step.

It should be added that a potential of the piezoelectric actuators in an initial condition is not important for the effect of the driving method according to the invention.

INDUSTRIAL APPLICABILITY

The driving method according to the present invention can be applied to ink-jet heads for use in various types of ink-jet printers.

What is claimed is:

1. A method of driving an ink-jet head having an ink chamber enclosed by walls with an ink supply inlet and a nozzle for ejecting ink and a wall of the ink chamber being a diaphragm and attached to a piezoelectric actuator, said method comprising:

applying a first driving voltage at a first rate to the piezoelectric actuator to deform proportionately the piezoelectric actuator causing the attached diaphragm to expand out from the ink chamber at a first speed and causing ink to enter the ink chamber;

applying a second driving voltage, which is less than the first driving voltage, at a second rate, which is less than the first rate, to the piezoelectric actuator to deform proportionately the piezoelectric actuator causing the attached diaphragm to expand out from the ink chamber at a second speed lesser than the first speed and further causing ink to enter the ink chamber;

applying a third driving voltage, which is greater than the second driving voltage, at a third rate, which is greater than the first rate, to the piezoelectric actuator to deform proportionately the piezoelectric actuator causing the attached diaphragm to contract in the direction of the ink chamber and causing ink to be ejected from the ink chamber; and selectively repeating the application of the first, the second and third driving voltages.

2. The method of driving an ink-jet head according to claim 1 wherein the magnitude of the first driving voltage and the second driving voltage applied to the piezoelectric actuator varies with time.

3. The method of driving an ink-jet head according to claim 1 wherein the magnitude of the second driving voltage is gradually increased while electric current to the piezoelectric actuator is kept at a constant value.

4. The method of driving an ink-jet head according to claim 1 wherein the length of time for applying the second driving voltage is substantially equal to a cycle period of the natural oscillation of the piezoelectric actuator.

5. The method of driving an ink-jet head according to claim 1 wherein the length of time for applying the second driving voltage is substantially equal to an integer times half a cycle period of the natural oscillation of the piezoelectric actuator.

6. A method of driving an ink-jet head having at least one ink chamber enclosed by walls with an ink supply inlet and a nozzle for ejecting ink and a wall of the at least one ink chamber being a diaphragm and attached to an alternately laminated piezoelectric actuator with a piezoelectric strain coefficient $d_{33}$, said method comprising:

applying a first driving voltage to the piezoelectric actuator, in the same direction of polarization of the piezoelectric actuator, to deform the piezoelectric actuator causing the attached diaphragm to contract toward the ink chamber;

applying a second driving voltage at a first rate to the piezoelectric actuator to deform proportionately the piezoelectric actuator causing the attached diaphragm to expand out from the at least one ink chamber at a first speed and causing ink to enter the at least one ink chamber;

applying a third driving voltage, which is less than the second driving voltage, at a second rate, which is less than the first rate, to the piezoelectric actuator to deform proportionately the piezoelectric actuator causing the attached diaphragm to expand out from the at least one ink chamber at a second speed lesser than the first speed and further causing ink to enter the at least one ink chamber;

applying a fourth driving voltage, which is greater than the third driving voltage, at a third rate, which is greater than the first rate, to the piezoelectric actuator to deform proportionately the piezoelectric actuator causing the attached diaphragm to contract in the direction of the at least one ink chamber and causing ink to be ejected from the at least one ink chamber; and selectively repeating the application of the first, second, third and fourth driving voltages.

7. The method of driving an ink-jet head according to claim 6 wherein the magnitude of the second driving voltage or the third driving voltage applied to the piezoelectric actuator varies with time.

8. The method of driving an ink-jet head according to claim 6 wherein the magnitude of the voltage of the third driving voltage is gradually increased while electric current to the piezoelectric actuator is kept at a constant value.

9. The method of driving an ink-jet head according to claim 6 wherein a length of time for applying the third driving voltage is substantially equal to a cycle period of the natural oscillation of the piezoelectric actuator.

10. The method of driving an ink-jet head according to claim 6 wherein the length of time for applying the third driving voltage is substantially equal to an integer times half a cycle period of the natural oscillation of the piezoelectric actuator.

11. A method of driving an ink-jet head according to claim 6 which further comprises a restoration step for restoring the inner volume of each of the ink chambers to the initial condition thereof after completion of the ink ejection step by controlling the behavior of the piezoelectric actuators.

12. A method of driving an ink-jet head having an ink chamber enclosed by walls with an ink supply inlet and a nozzle for ejecting ink and a wall of the ink chamber being a diaphragm and attached to a piezoelectric actuator, said method comprising:

applying a first driving voltage at a first rate to the piezoelectric actuator to deform proportionately the piezoelectric actuator causing the attached diaphragm to expand out from the ink chamber at a first speed and causing ink to enter the ink chamber;

applying a second driving voltage, which is less than the first driving voltage, at a second rate, which is less than the first rate, to the piezoelectric actuator to deform proportionately the piezoelectric actuator causing the attached diaphragm to expand out from the ink chamber at a second speed lesser than the first speed and further causing ink to enter the ink chamber;

applying a third driving voltage, which is greater than the second driving voltage, at a third rate, which is greater than the first rate, to the piezoelectric actuator to deform proportionately the piezoelectric actuator causing the attached diaphragm to contract in the direction of the ink chamber and causing ink to be ejected from the ink chamber, whereby the ink ejected is formed into droplets and the size of the droplets are adjusted by varying the magnitude of the second driving voltage and length of time of application of the second driving voltage; and selectively repeating the application of the first, the second and third driving voltages.

13. The method of driving an ink-jet head according to claim 12 wherein the magnitude of the first driving voltage and the second driving voltage is varied with time.

14. The method of driving an ink-jet head according to claim 12 wherein the magnitude of the second driving voltage is gradually increased while electric current to the piezoelectric actuator is kept at a constant value.

15. The method of driving an ink-jet head according to claim 12 wherein a length of time for applying the third driving voltage is substantially equal to a cycle period of the natural oscillation of the piezoelectric actuator.

16. The method of driving an ink-jet head according to claim 12 wherein in the length of time for applying the second driving voltage is substantially equal to an integer times half a cycle period of the natural oscillation of the piezoelectric actuator.

17. A method of driving an ink-jet head having at least one ink chamber enclosed by walls with an ink supply inlet and a nozzle for ejecting ink and a wall of the at least one ink chamber being a diaphragm and attached to an alternately laminated piezoelectric actuator with a piezoelectric strain coefficient $d_{33}$, said method comprising:

applying a first driving voltage to the piezoelectric actuator, in the same direction of polarization of the piezoelectric actuator, to deform the piezoelectric actuator causing the attached diaphragm to contract toward the ink chamber;

applying a second driving voltage at a first rate to the piezoelectric actuator to deform proportionately the piezoelectric actuator causing the attached diaphragm to expand out from the at least one ink chamber at a first speed and causing ink to enter the at least one ink chamber;

applying a third driving voltage, which is less than the second driving voltage, at a second rate, which is less than the first rate, to the piezoelectric actuator to deform proportionately the piezoelectric actuator causing the attached diaphragm to expand out from the at least one ink chamber at a second speed lesser than the first speed and further causing ink to enter the at least one ink chamber;

applying a fourth driving voltage, which is greater than the third driving voltage, at a third rate, which is greater than the first rate, to the piezoelectric actuator to deform proportionately the piezoelectric actuator causing the attached diaphragm to contract in the direction of the at least one ink chamber and causing ink to be ejected from the at least one ink chamber, whereby the ink ejected is formed into droplets and the size of the droplets are adjusted by varying the magnitude of the third driving voltage and length of time of application of the third driving voltage; and selectively repeating the application of the first, second, third and fourth driving voltages.

18. The method of driving an ink-jet head according to claim 17 wherein the magnitude of the second driving voltage and the third driving voltage is varied with time.

19. The method of driving an ink-jet head according to claim 17 wherein the magnitude of the third driving voltage applied is increased gradually while electric current to the piezoelectric actuator is kept at a constant value.

20. The method of driving an ink-jet head according to claim 17 wherein a length of time for applying a fourth driving voltage is substantially equal to a cycle period of the natural oscillation of the piezoelectric actuator.

21. The method of driving an ink-jet head according to claim 17 wherein the length of time for applying the third driving voltage is substantially equal to an integer times half a cycle period of the natural oscillation of the piezoelectric actuator.

* * * * *

UNITED STATES PATENT AND TRADEMARK OFFICE

CERTIFICATE OF CORRECTION

PATENT NO. : 6,106,091
DATED : August 22, 2000
INVENTOR(S) : Osawa et al.

It is certified that error appears in the above-identified patent and that said Letters Patent is hereby corrected as shown below:

In the Drawings;
On sheet 10, delete the entire FIG. 14.
On sheet 11, delete "sheet 11 of 13" and change to -- Sheet 10 of 12 --.
On sheet 12, delete "sheet 12 of 13" and change to -- Sheet 11 of 12 --.
On sheet 13, delete "sheet 13 of 13" and change to -- Sheet 12 of 12 --.

Signed and Sealed this

Seventh Day of August, 2001

*Attest:*

Nicholas P. Godici

*Attesting Officer*

NICHOLAS P. GODICI
*Acting Director of the United States Patent and Trademark Office*